US006991361B2

(12) United States Patent
Flood

(10) Patent No.: US 6,991,361 B2
(45) Date of Patent: Jan. 31, 2006

(54) PORTABLE CONCRETE PLANT

(75) Inventor: Jeffrey Flood, Shakopee, MN (US)

(73) Assignee: Advanced Concrete Innovations, Inc., Jordan, MN (US)

( * ) Notice: Subject to any disclaimer, the term of this patent is extended or adjusted under 35 U.S.C. 154(b) by 0 days.

(21) Appl. No.: 10/103,649

(22) Filed: Mar. 21, 2002

(65) Prior Publication Data

US 2003/0002384 A1 Jan. 2, 2003

Related U.S. Application Data

(63) Continuation-in-part of application No. 09/826,979, filed on Apr. 5, 2001.

(60) Provisional application No. 60/194,703, filed on Apr. 5, 2000.

(51) Int. Cl.
*B28C 5/16* (2006.01)

(52) U.S. Cl. ..... 366/18; 366/22; 366/27; 366/65; 366/67

(58) Field of Classification Search ..... 366/7, 366/8, 16, 18, 20, 22, 23, 27, 29, 64–67, 366/141, 148, 153.3, 304, 309
See application file for complete search history.

(56) References Cited

U.S. PATENT DOCUMENTS

| | | | | |
|---|---|---|---|---|
| 1,923,151 A | | 8/1933 | Koehring | |
| 2,015,488 A | | 9/1935 | Manabe | |
| 4,106,111 A | | 8/1978 | Rose | 366/3 |
| 4,298,288 A | | 11/1981 | Weisbrod | 366/8 |
| 4,452,535 A | | 6/1984 | Reid | 366/22 |
| 4,588,299 A | | 5/1986 | Brown et al. | 366/8 |
| 4,589,454 A | | 5/1986 | Kelley | 141/68 |
| 4,775,275 A | * | 10/1988 | Perry | 414/21 |
| 4,865,457 A | | 9/1989 | Strehlow | 366/2 |
| 4,963,031 A | | 10/1990 | Brown | 366/2 |
| 4,976,378 A | | 12/1990 | Bush | 222/55 |
| 5,121,989 A | * | 6/1992 | Horton et al. | 366/18 |
| 5,407,299 A | | 4/1995 | Sutton | 404/75 |
| 5,427,448 A | | 6/1995 | Macaulay et al. | 366/6 |
| 5,718,508 A | | 2/1998 | Williams | 366/138 |
| 5,730,523 A | | 3/1998 | Flood | 366/18 |
| 5,908,240 A | | 6/1999 | Hood | 366/18 |
| 5,934,801 A | | 8/1999 | List et al. | 366/99 |
| 6,030,112 A | | 2/2000 | Milek | 366/64 |
| 6,126,307 A | * | 10/2000 | Black et al. | 366/43 |
| 6,186,654 B1 | * | 2/2001 | Gunteret, Jr. et al. | 366/18 |

OTHER PUBLICATIONS

ALSLUR Brochure 1999.

* cited by examiner

*Primary Examiner*—David Sorkin
(74) *Attorney, Agent, or Firm*—Gerald E. Helget; Briggs and Morgan, P.A.

(57) ABSTRACT

A portable concrete plant for producing ready mix concrete proximate to a location where the ready mix concrete is used. The portable concrete plant includes storage regions for storing components used in the ready mix concrete. The portable concrete plant also includes a slurry mixer for preparing slurry that is used in the ready mix concrete. The portable concrete plant further includes conveying systems for conveying the components from the storage regions and from the slurry mixer to a system discharge port.

18 Claims, 9 Drawing Sheets

PORTABLE CONCRETE PLANT

RELATED U.S. APPLICATION DATA

This application is a continuation-in-part of U.S. application Ser. No. 09/826,979, filed Apr. 5, 2001, which claims priority to U.S. Provisional Application Ser. No. 60/194,703, filed Apr. 5, 2000.

FIELD OF THE INVENTION

The present invention relates generally to a concrete plant. More particularly, the present invention relates to a portable concrete plant.

BACKGROUND OF THE INVENTION

Concrete is used in constructing a variety of different structures such as buildings, bridges and roads. Typically concrete is prepared in the form of ready mix concrete at a central location and then transported via truck to a location where the ready mix concrete is to be used. While this technique allows larger batches of ready mix concrete to be produced, the quality of concrete varies significantly depending on the distance between location where the ready mix concrete is prepared and the location where the ready mix concrete is used as the ready mix concrete begins the curing process as soon as it is prepared. As such, it is often necessary to add components to the ready mix concrete that either slows or speeds the curing process.

In an attempt to overcome the drawbacks associated with producing ready mix concrete at a central location and then trucking the ready mix concrete to the use locations, it has been proposed to create a concrete plant that is portable such that the portable concrete plant may be transported to a location that is proximate where the ready mix concrete will be used. For example, Flood, U.S. Pat. No. 5,730,523, describes a portable concrete plant that is mounted on a single vehicle. The Flood portable concrete plant includes hoppers for storing rock, sand, cement and water. The Flood portable concrete plant also has a conveyor system that conveys the rock, sand and cement into a rotating drum where the components are mixed with water to prepare ready mix concrete. A pump is used for dispensing the ready mix concrete from the rotating drum.

Weisbrod, U.S. Pat. No. 4,298,288, discloses a portable concrete apparatus that is suited for preparing ready mix concrete proximate to a location where the concrete is to be used. The Weisbrod apparatus feeds rock, sand, cement and water at different locations along a mixing auger. Once sufficiently mixed, the ready mix concrete is pumped through a hose to the location where it is used. The Weisbrod system is particularly suited for use with preparing relatively small amounts of ready mix concrete.

One of the important components of a system that prepares ready mix concrete is the slurry mixer that mixes water, cement and other components into a slurry, which then can be mixed with rock and sand to produce the ready mix concrete. Brown et al., U.S. Pat. No. 4,588,299, and Strehlow, U.S. Pat. No. 4,865,457, each disclose a slurry mixer having a horizontally oriented mixing region.

Milek, U.S. Pat. No. 6,030,112, discloses a slurry batch mixer that has an elongated configuration. The slurry batch mixer has a trough with a curved bottom. A ribbon type screw conveyor is mounted in the trough parallel to an axis of the trough. Rotation of the screw conveyor not only mixes the components together but also conveys the mixed components to a discharge port of the trough. Williams, U.S. Pat. No. 5,718,508, discloses a self-cleaning slurry mixer having a cylindrical shape with a feed screw extending therethrough to mix together the components and to convey the mixed slurry to the slurry outlet. Macauley et al., U.S. Pat. No. 5,427,448, describes a twin screw slurry mixer where the screws are oriented parallel to each other.

Hood, U.S. Pat. No. 5,908,240, describes a tank-type slurry mixer that has two sets of paddles rotatably mounted therein. The paddles cause the mixture to be drawn in the downward direction and then flow upwardly along the side walls of the tank. Brown, U.S. Pat. No. 4,963,031, also discloses a tank-type slurry mixer. None of the prior art references or discloses a portable concrete plant that is suitable for producing ready mix concrete at rates of between 75 and 200 cubic yards per hour as is typically required for commercial applications.

Accurately controlling the flow of rock and sand also plays an important role in preparing ready mix concrete with consistent characteristics. Bush, U.S. Pat. No. 4,976,378, describes a paddle-type feed metering system. The Bush device includes four paddles that are rotatably mounted in an enclosure. Rotation of the paddle dispenses a predetermined weight of material.

SUMMARY OF THE INVENTION

The present invention relates to a portable concrete plant for preparing ready mix concrete proximate to a location where the ready mix concrete is to be used. The portable concrete plant includes a frame, a rock storage region, a sand storage region, a cement storage region, a water storage region, a slurry mixer, and a conveyor system.

The frame has at least one set of wheels attached thereto for supporting the frame above a ground surface and permitting the frame to be moved along the ground surface. The cement storage region stores cement and is attached to the frame. The cement storage region has a cement entry port and a cement exit port. The sand storage region stores sand and is attached to the frame. The sand storage region has a sand entry port and a sand exit port. The rock storage region stores rock and is attached to the frame. The rock storage region has a rock entry port and a rock exit port. The water storage region stores water and is attached to the frame. The water storage region has a water entry port and a water exit port.

The slurry mixer is attached to the frame. The slurry mixer has a slurry mixer entry port and a slurry mixer exit port. The cement exit port and the water exit port are operably connected to the slurry mixer entry port. The slurry mixer prepares a slurry from cement and water.

The first conveyor system is attached to the frame. The first conveyor system receives rock from the rock exit port and sand from the sand exit port and transports the rock and sand to a system exit port. The first conveyor system and the slurry mixer exit port intersect proximate to the system exit port to cause the slurry to be mixed with the sand and rock for preparing the ready mix concrete.

DETAILED DESCRIPTION OF THE PREFERRED EMBODIMENTS

Figure 1:
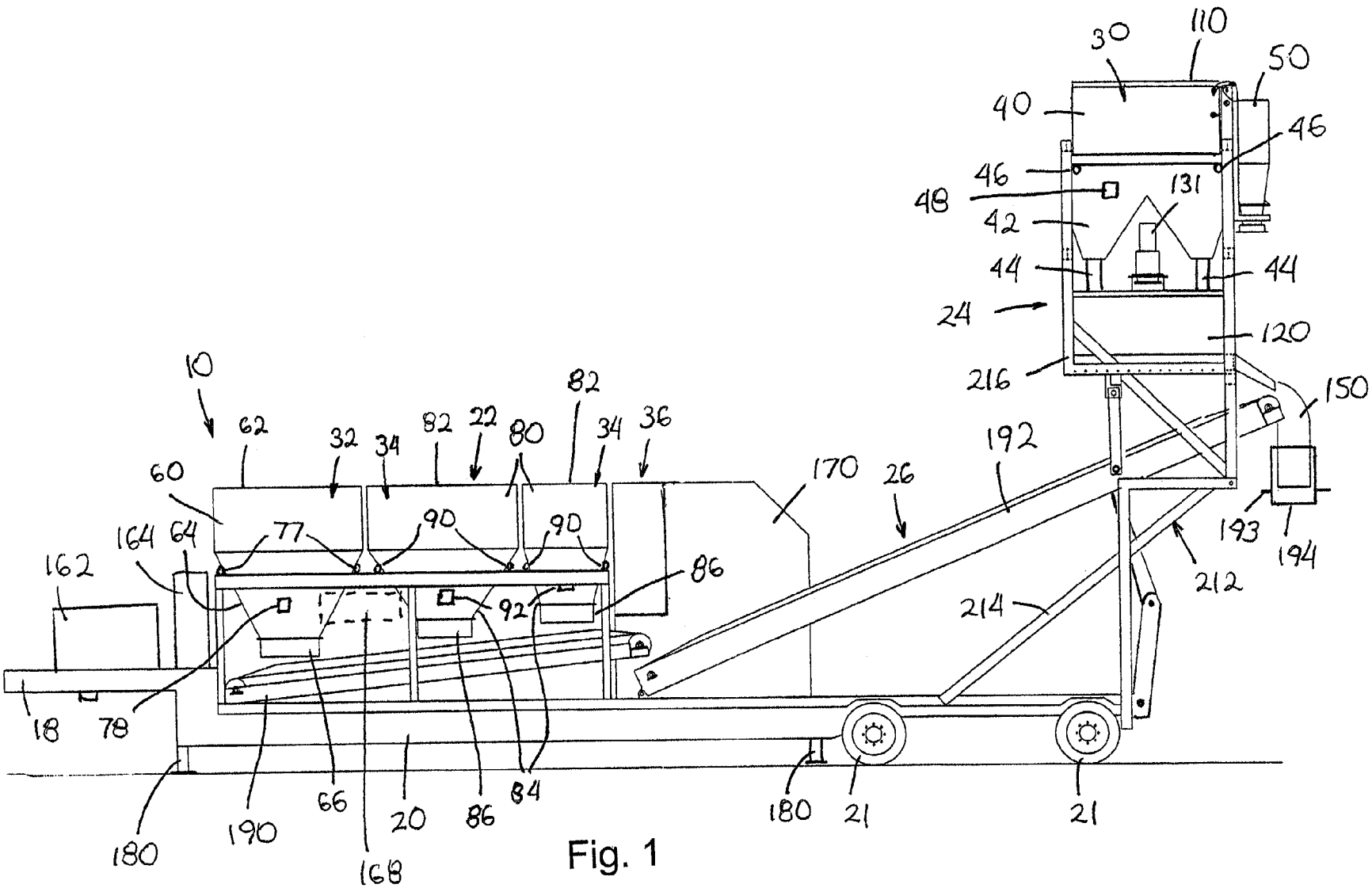
FIG. 1 is a side view of a portable concrete plant according to the present invention in a use configuration.
Figure 2:
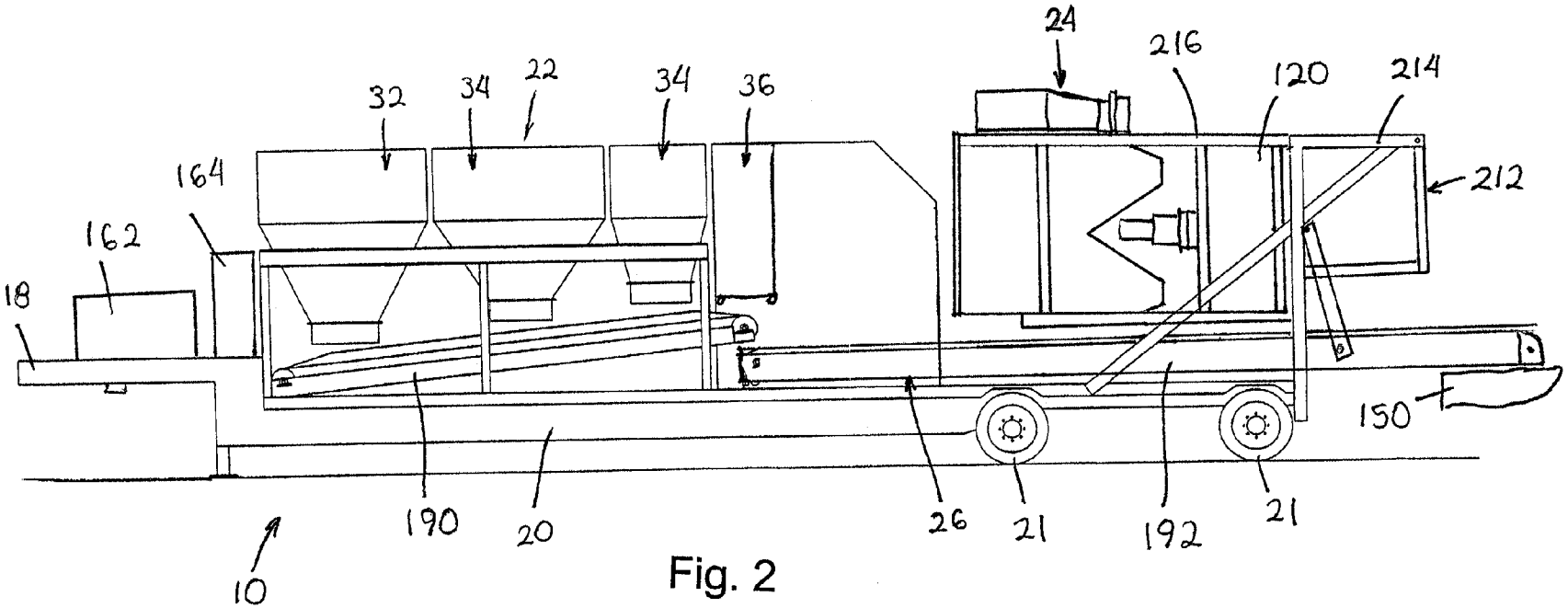
FIG. 2 is a side view of the portable concrete plant in a transport configuration.

The present invention is directed to a portable concrete plant, as most clearly illustrated at 10 in FIGS. 1 and 2. The portable concrete plant 10 is capable of producing between about 75 and 200 cubic yards of ready mix concrete per hour. The portable concrete plant 10 is suited for use proximate a location where the ready mix concrete is to be used. The portable concrete plant 10 thereby reduces the cost of transporting the ready mix concrete to the location where the concrete is to be used.

The portable concrete plant 10 also enhances the quality of the concrete by eliminating wet or dry loads that are caused by variations in delivery time to the location where the ready mix concrete is to be used. By reducing these variations, qualities of the finished concrete such as strength are enhanced.

It is possible to use the portable concrete plant 10 in a variety of locations with only minimal preparations to the locations, such as providing a relatively flat and stable surface. The portable concrete plant 10 has a relatively low center of gravity, which makes the portable concrete plant 10 stable to use on a variety of ground surfaces.

The portable concrete plant 10 generally includes a frame 20, a material storage region 22, a material mixing region 24 and a mixed material delivery region 26 that are each mounted to the frame 20. The frame 20 is preferably fabricated to extend around the components of the portable concrete plant 10.

The frame 20 is constructed to maintain the components of the portable concrete plant 10 in a fixed position not only during use of the portable concrete plant 10 but also during transportation of the portable concrete plant 10 to a location where the portable concrete plant 10 is to be used.

The frame 20 is preferably selected with a width, length and height that permit the portable concrete plant 10 to meet substantially all of the applicable road size regulations such that the portable concrete plant 10 may be transported over a significant percentage of the roads without obtaining special permits. For most applications, the width is less than about 102 inches, the length is less than about 61 feet, and the height is less than about 13 feet 6 inches.

The frame 20 preferably includes a gooseneck 18 that facilitates attaching the portable concrete plant 10 to a truck for transporting the portable concrete plant 10 to a desired use location.

The frame 20 is supported by at least one set of wheels 21 that permit the portable concrete plant 10 to be easily transported to a desired use location. The number of sets of wheels 21 and the number of wheels in each set of wheels 21 is selected based upon the applicable weight limitations. For most applications, the portable concrete plant 10 has two sets of wheels 21 that include two wheels on each side of the frame 20.

Sides of the portable concrete plant 10 are preferably covered by tarps (not shown) that protect the components of the portable concrete plant 10 during cold weather operations and facilitate heating of the components to prevent freezing of the materials in the portable concrete plant. The tarps also protect the portable concrete plant 10 during transportation or while not in use. A heat exchanger (not shown) may be positioned underneath the tarp to heat the materials used in the portable concrete plant 10 during cold weather to prevent freezing of materials used in the portable concrete plant 10.

The tarps are preferably retractable to a relatively small region proximate the top of the frame when the tarps are not in use to provide access to the components of the portable concrete plant 10. A person of ordinary skill in the art will appreciate that a variety of materials are suitable for use in fabricating the tarp. A person of ordinary skill in the art will also appreciate that a variety of mechanisms are suitable for either automatically or manually moving the tarps from an extended position to the retracted position.

Figure 3:
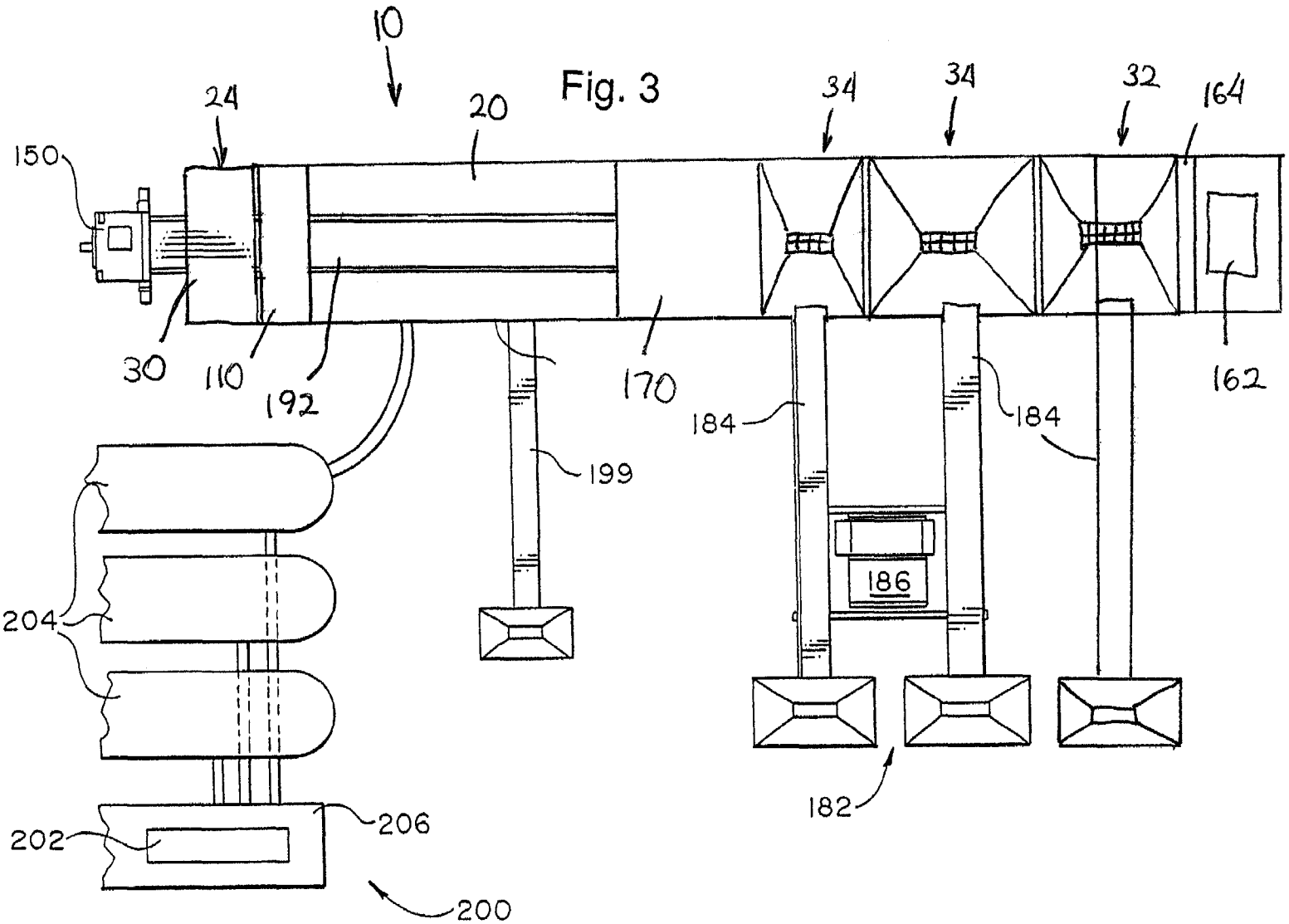
FIG. 3 is a top view of the portable concrete plant and material feed conveyor systems.

The material storage region 22 preferably has a separate storage area for each of the materials that are used for preparing the ready mix concrete, as most clearly illustrated in FIGS. 1 and 3. The material storage region 22 preferably includes a portland cement storage region 30, a sand storage region 32, a rock storage region 34, and a water storage region 36. The material storage region 22 may also include storage regions for one or more admixes that are added during the concrete preparation process.

While the present invention only illustrates the use of two rock storage regions 34, a person of ordinary skill in the art will appreciate that it is possible to utilize the concepts of the present invention in conjunction with multiple sizes of rock that are each stored separately.

The cement storage region 30 includes a cement hopper 40 with a substantially enclosed upper end and a tapered lower portion 42. The cement hopper 40 has a capacity of greater than 50 cubic feet, preferably between 100 cubic feet and 200 cubic feet and most preferably about 150 cubic feet.

Figure 4:
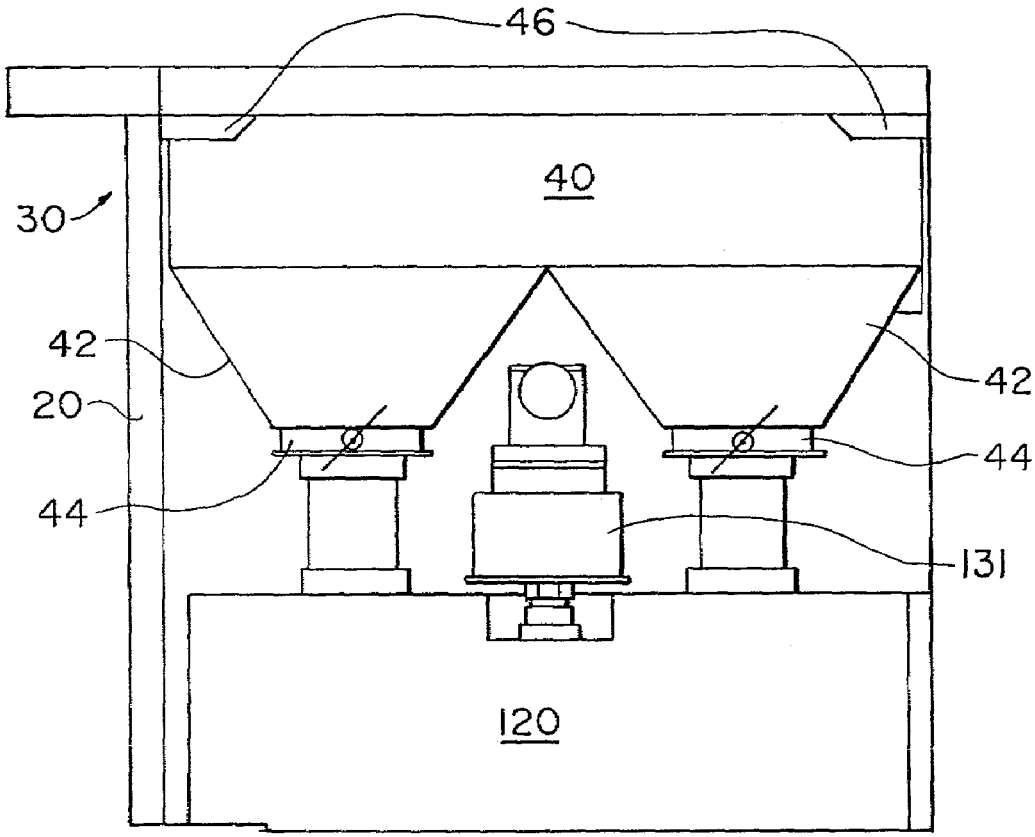
FIG. 4 is a side view of a cement storage region of the portable concrete plant.

Proximate the lower portion 42, the cement storage region 30 has a flow control mechanism 44 that controls the flow of cement from the cement storage region 30, most clearly illustrated in FIG. 4.

Preferably, the cement storage region 30 includes two flow control mechanisms 44. Using the two flow control mechanisms 44 enhances the ability to accurately control the rate at which cement is dispensed from the cement hopper 40. Using two flow control mechanisms 44 also enhances the even loading of a paddle system in the slurry mixer 120 and thereby reduces large torque differentials that can lead to potential damage of the components in the slurry mixer 120. Using the two flow control mechanisms 44 also enhances the ability to rapidly load the cement into the slurry mixer 120. In particular, approximately 5,640 pounds of cement, which is needed for preparing 10 yards of ready mix concrete in a 6 bag mix protocol, is loaded into the slurry mixer 120 in less than 30 seconds and preferably about 15 seconds.

The flow control mechanism 44 preferably includes a rotatably mounted gate valve. However, a person of ordinary skill in the art will appreciate that other valve mechanisms may be used to control the flow of cement from the cement hopper 40. Operation of the flow control mechanism 44 is preferably controlled by operable attachment to a hydraulic system in the portable concrete plant 10, which is described in more detail herein. Alternatively, it is possible to control the operation of the flow control mechanism using an electrical or pneumatic control system.

The cement hopper 40 is preferably mounted to the frame 20 using a load cell 46 that permits the weight of cement hopper 40 to be monitored on a continuous basis. Continuous monitoring of the weight of the cement hopper 40 enhances the ability to accurately add cement during the concrete preparation process. Such a system is typically referred to as a loss in weight charge system.

To enhance the ability to produce a steady flow of cement from the cement hopper 40, the cement storage region 30 preferably includes a vibrator 48 operably attached thereto. To minimize the noise associated with the bin vibrator 48 as well as the wear and tear on the components of the cement storage region 30, the bin vibrator 48 is preferably only activated while the flow control mechanism 44 is in operation.

A dust collection system 50 is preferably provided on the cement storage region 30 to collect dust that is generated by moving the cement into and out of the cement storage region 30. The dust collection system 50 includes a series of filter cartridges (not shown) on which the dust is collected. The total surface area provided by the filter cartridges is between 500 and 2000 square feet and preferably about 1000 square feet.

At selected intervals the dust is removed from the filter cartridges. Since the filter cartridges are mounted above the cement storage region 30, the dust falls into the cement storage region 30 when it is removed from the filter cartridges. This recycling system minimizes the amount of cement dust that must be disposed of and extends the life of the filter cartridges. The dust collection system 50 also preferably includes a port (not shown) that provides operators with the ability to inspect the filter cartridges to determine when it is necessary to replace the filter cartridges. The port also provides the ability to easily access the filter cartridges when it is necessary to replace the filter cartridges.

Cement is preferably supplied to the cement storage region 30 from an auxiliary bulk cement storage tanker (not shown) that is operably connected to the cement storage region 30 with a cement transfer line (not shown). The auxiliary bulk cement storage tanker is operably connected to the portable concrete plant 10 using hydraulically operated control valves that permit the flow of cement to be controlled from a control room on the portable concrete plant 10. Transfer of the cement from the auxiliary bulk cement storage tanks is preferably performed using conventionally known techniques such as with blowing air.

Figure 5:
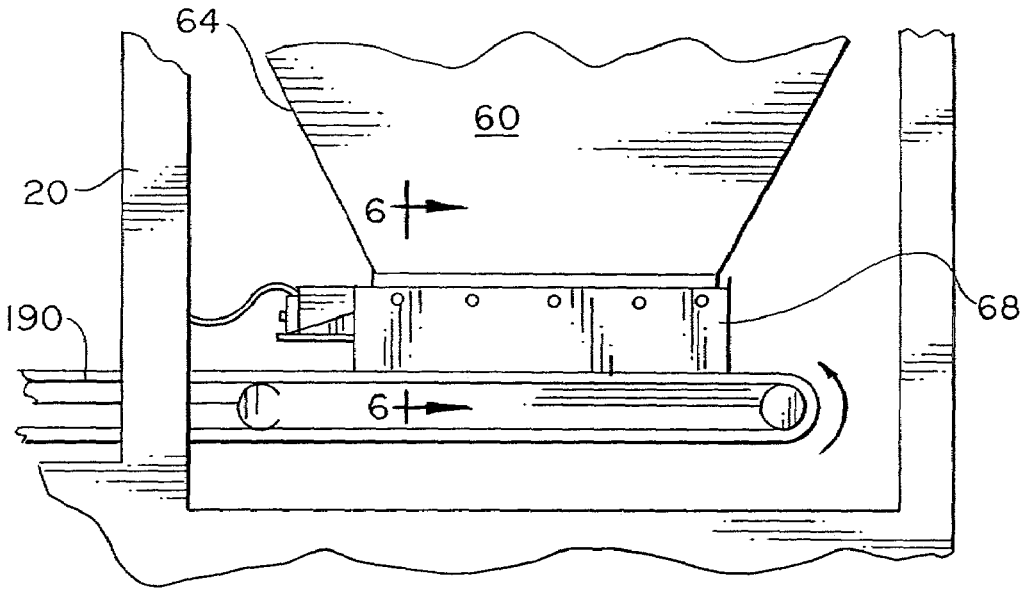
FIG. 5 is a side view of a sand flow metering device for use in the portable concrete plant.
Figure 6:
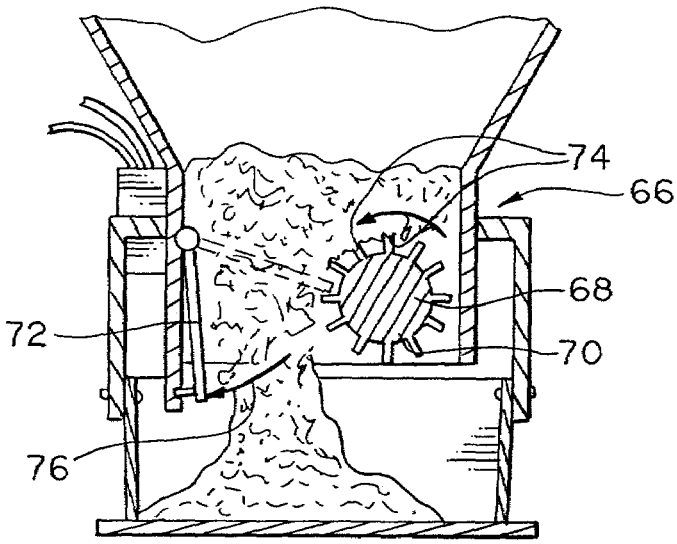
FIG. 6 is a sectional view of the sand flow metering device taken along a line 6—6 in FIG. 5.

The sand storage region 32 includes a sand hopper 60 having a substantially open upper portion 62 that tapers down to a lower portion 64. The hopper 60 preferably has a storage capacity of approximately seven cubic yards. The substantially open upper portion 62 permits sand to be replenished into the sand hopper 60. Proximate the lower portion 64, the sand storage region 32 has a flow control mechanism 66 that controls the flow of sand from the sand storage region 32. The flow control mechanism 66 is preferably a paddle metering valve 68 such as is illustrated in FIGS. 5 and 6. The paddle metering valve 68 reduces material bridging in the sand hopper 60 and provides the ability to individually control the rates at which the materials are dispensed from the sand hopper 60.

The paddle metering valve 68 generally includes two elements the rotatable paddle element 70 and the gate element 72. The rotatable paddle element 70 has a plurality of paddles 74 extending therefrom. The rotatable paddle element 74 is oriented to rotate parallel to the direction in which the sand is falling out of the sand hopper 60.

The gate element 72 is pivotable between a closed position oriented adjacent to the rotatable paddle element 70 and an open position. When in the closed position the rotatable paddle element 70 and the gate element 72 substantially prevent flow of sand from the sand hopper 60. When the gate element 72 pivots from the closed position to the open position as indicated by arrow 76, the sand is permitted to flow from the sand hopper 60.

Rotation of the rotatable paddle element 70 thereby enhances the ability to produce an even sand flow rate. Changing the rate at which the rotatable paddle element 70 is rotated allows the sand flow rate to be changed. Positioning the gate element 72 at intermediate positions between the open position and the closed position also permits the sand flow rate to be varied.

The sand storage region 32 is preferably mounted to the frame 20 using a load cell 77 that permits the weight of sand hopper 60 to be monitored on a continuous basis. Continuous monitoring of the weight of the sand hopper 60 enhances the ability to accurately add sand during the concrete preparation process. Continuous monitoring of the weight of sand in the sand hopper 60 also provides the operator with an indication as to when it is necessary to replenish the sand in the sand hopper 60.

To enhance the ability to produce a steady flow of sand from the sand hopper 60, the sand storage region 32 preferably includes a vibrator 78 operably attached thereto. To minimize the noise associated with the bin vibrator 78 as well as the wear and tear on the components of the sand storage region 32, the bin vibrator 78 is preferably only activated while the flow control mechanism 66 is operating.

The rock storage region 34 includes a rock hopper 80 having a substantially open upper portion 82 that tapers down to a lower portion 84, as most clearly illustrated in FIG. 1. The hopper 80 preferably has a storage capacity of approximately seven cubic yards. The substantially open upper portion 82 permits rock to be replenished into the rock hopper 80. Proximate the lower portion 84, the rock storage region 34 has a flow control mechanism 86 that controls the flow of rock from the rock storage region 34. The flow control mechanism 86 preferably includes a pair of gates that are pivotally mounted proximate the lower portion 84.

Pivoting of the gates to a closed position prevents rock from flowing out of the rock hopper 80. Pivoting of the gates to an open position permits rock to flow out of the rock hopper 80. Pivoting of the gates between the open position and the closed position is preferably controlled by a hydraulic cylinder (not shown). The metering valve preferably includes a flow control that permits slow opening of the valve to promote controlled free fall and rapid closing of the valve to promote accurately attaining the target material weight.

The rock hopper 80 is mounted to the frame 20 using a load cell 90 that permits the weight of the rock hopper 80 to be obtained on a continuous basis. Continuous monitoring of the weight of the rock hopper 80 enhances the ability to accurately add rock during the concrete preparation process. Continuous monitoring of the weight of rock in the rock hopper 80 also provides the operator with an indication as to when it is necessary to replenish the rock in the rock hopper 80.

To enhance the ability to produce a steady flow of rock from the rock hopper 80, the rock storage region 34 preferably includes a vibrator 92 operably attached thereto. To minimize the noise associated with the bin vibrator 92 as well as the wear and tear on the components of the rock storage region 34, the bin vibrator 92 is preferably only activated while the flow control mechanism 86 is in operation.

The water storage region 36 includes a substantially enclosed vessel 110 having a capacity of between about 100 gallons and 500 gallons. The portable concrete plant 10 has a weight cell 112 that attaches the water storage vessel 110. The weight cell 112 permits the weight of the water storage vessel 110 to be continuously monitored to accurately control the delivery of water in the cement preparation process. The weight cell 112 also provides the operator with an indication when it is necessary to refill the water storage vessel 110.

As an alternative to manually monitoring the water level in the water storage vessel 110, the water level may be automatically controlled to refill the water storage vessel 110 from a water source. Depending on the location where the portable concrete plant 10 is used, the water source is typically either a tanker filled with water or attachment to a municipal water supply such as through a fire hydrant.

Figure 7:
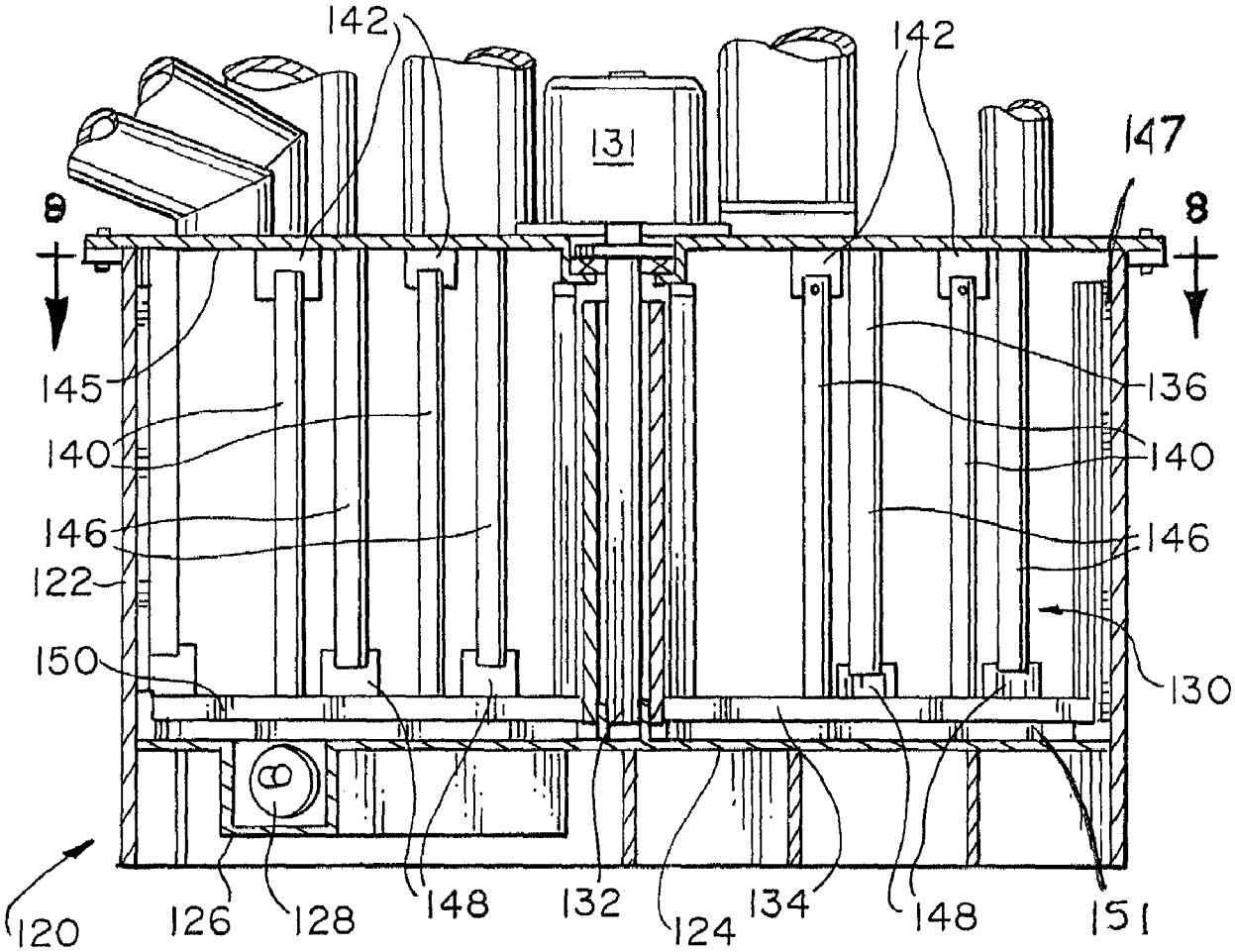
FIG. 7 is a sectional view of the slurry mixer taken along a line 7—7 in FIG. 1.
Figure 8:
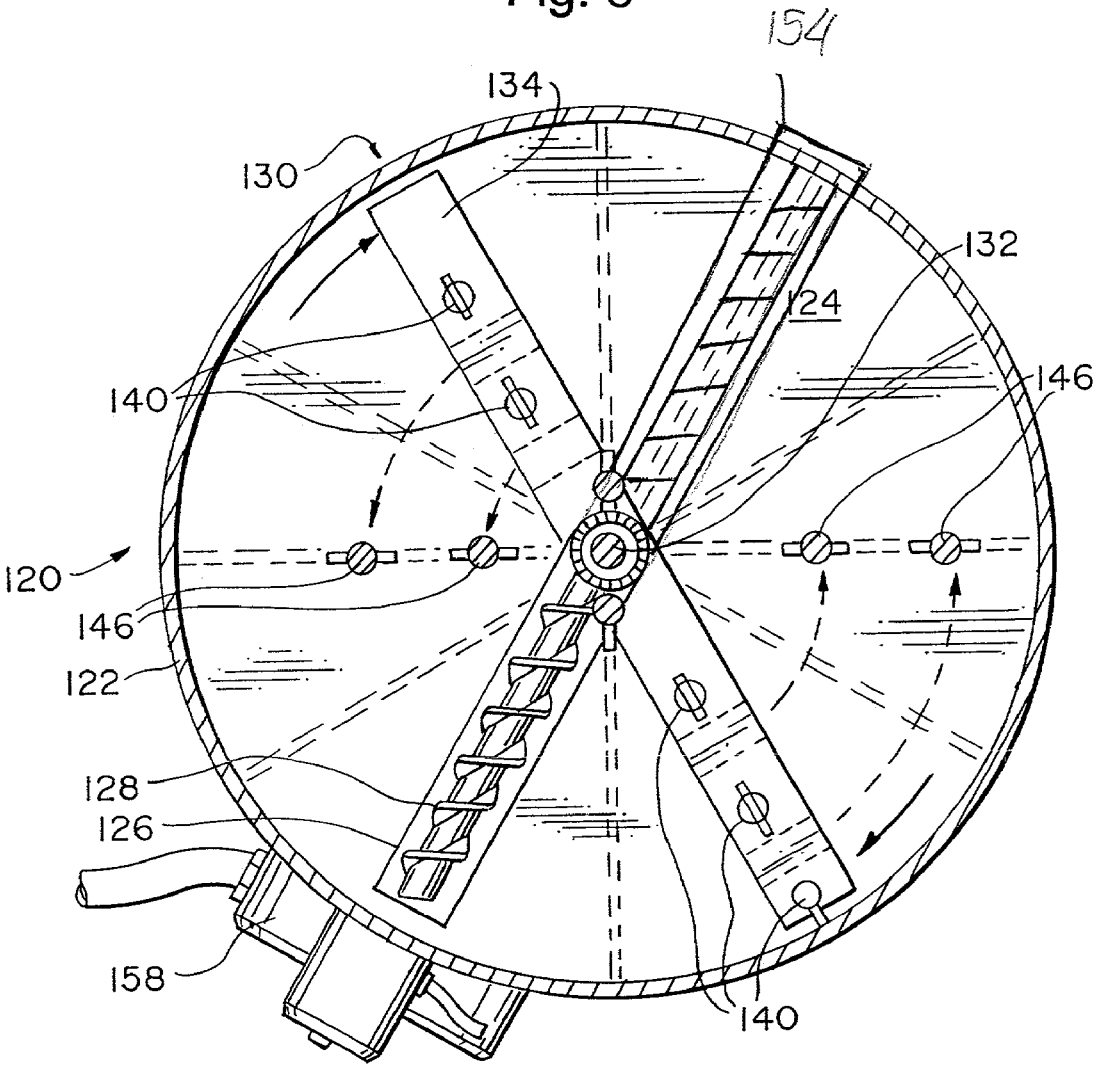
FIG. 8 is a sectional view of the slurry mixer taken along a line 8—8 in FIG. 7.
Figure 9:
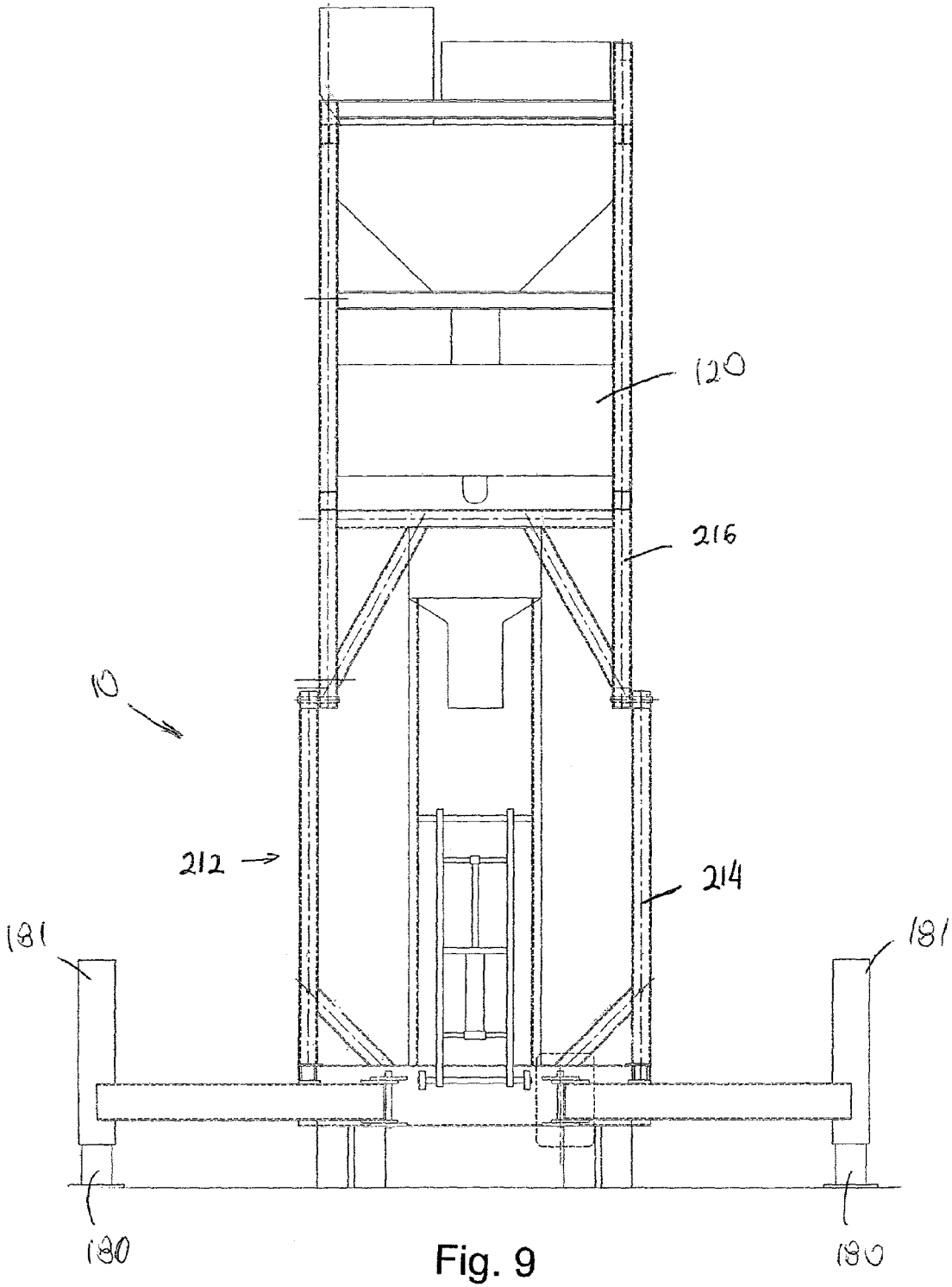
FIG. 9 is a back view of the portable concrete plant.
Figure 11:
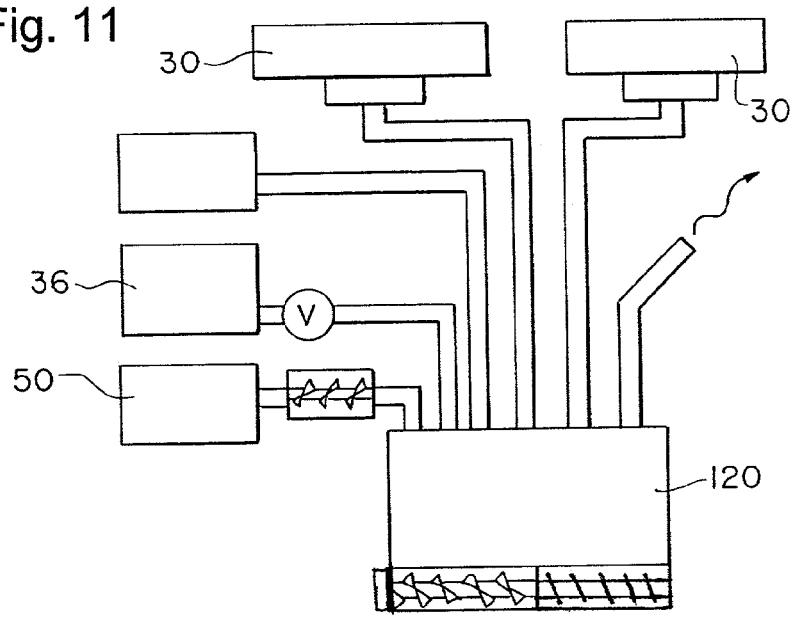
FIG. 11 is a schematic illustration showing material flow paths into and out of the slurry mixer.

The material mixing region 24 includes a slurry mixer 120 having a generally cylindrical shape with a side wall 122 and a base wall 124 that encloses a lower end of the slurry mixer 120, as most clearly illustrated in FIGS. 7–9.

The slurry mixer 120 is pivotally mounted to the frame 20 so that the slurry mixer 120 is movable between an extended position (illustrated in FIG. 1) and a storage position (illustrated in FIG. 2). When in the storage position, the portable concrete plant 10 has a height that permits the portable concrete plant 10 to be transported over most roads. When in the extended position, an exit port from the slurry mixer 120 is sufficiently high to permit slurry to be delivered from the slurry mixer 120 to a conventional concrete truck (not shown) by gravity. The portable concrete plant 10 thereby obviates the need to pump slurry, which is often difficult because of the viscosity of the slurry.

A slurry mixer support frame 212 has a stationary portion that extends upwardly from the frame 20 and a pivoting portion 216 opposite the frame 20. Pivoting of the pivoting portion 216 with respect to the stationary portion 214 is preferably controlled with a hydraulic cylinder. Once in the extended position, at least one locking pin (not shown) is extended through the pivoting portion 216 and the stationary portion 214 to thereby lock the pivoting portion 216 in the extended position without relying on the hydraulic system. The locking pins are preferably moved between the locked and unlocked positions using a hydraulic cylinder (not shown).

A dispensing channel 126 is provided in the base wall 124 for conveying slurry out of the slurry mixer 120 as illustrated in FIGS. 7 and 8. A dispensing auger 128 is rotatably mounted in the dispensing channel 126. Rotation of the dispensing auger 128 conveys the slurry out of the dispensing channel 126. An end of the dispensing auger 128 is located proximate to the discharge boot 150.

A slurry control valve 154 substantially covers the end of to dispensing auger so that slurry only flows out of the slurry mixer 120 when desired. The slurry control valve 154 is pivotable between an open position and a closed position. Pivoting of this slurry control valve 154 between the open position and the closed position is preferably controlled using a hydraulic cylinder or other similar mechanism (not shown).

The slurry mixer 120 has a paddle system 130 rotatably mounted therein for mixing together the materials placed in the slurry mixer 120. Rotation of the paddle system 130 is preferably controlled by a top-mounted motor 131. Using the top-mounted motor 131 eliminates the need to use high maintenance shaft seals and permits the dispensing auger 128 to span the entire bottom of the slurry mixer 120. This configuration also enhances the ability to perform end of day cleaning on the components of the slurry mixer 120.

The paddle system 130 has a preferably self-cleaning configuration to facilitate removing all of the slurry from the slurry mixer 120 at the end of each work day. The self cleaning capability thereby minimizes the time and effort needed to clean the slurry mixer 120 and assures complete slurry removal from the slurry mixer 120.

The paddle system 130 includes a central member 132 and lower rotating member 134 that extends from the central member 132 to proximate the side wall 122.

Lower mixing members 140 extend upwardly from the lower rotating member 134. An upper wiper 142 may be attached to an upper end of the lower mixing members 140 so that the upper wipers 142 slide over a top cover 145 to thereby wipe slurry mixture from the top cover 145. Similarly, upper mixing members 146 extend downwardly from the top cover 145. A lower wiper 148 may be attached to a lower end of the upper mixing member 146 so that the lower wiper 148 slides over an upper surface of the lower member 134 to thereby wipe slurry mixture from the lower member 134.

The upper mixing members 146 are preferably removably mounted in the slurry mixer 24. This configuration permits the upper mixing members 146 to be removed when damaged or when otherwise desired. The upper mixing members are preferably attached to the top cover 145 of the slurry mixer 24 using bolts (not shown).

Rotation of the lower rotating members 134 causes the lower mixing members 140 to move between the upper mixing members 146 and thereby cause the water, cement and other components placed in the slurry mixer 120 to be mixed together to produce a slurry. The slurry mixer 120 permits the water, cement and other components to be mixed in less than 60 seconds and preferably between about 15 seconds and 30 seconds. The slurry mixer 120 of the present invention promotes a high degree of mixing such that nearly all of the cement particles are coated with water.

While not necessary, the components in the slurry mixer 120 may be plastic coated to reduce sticking of the slurry to the components of the slurry mixer 120. Using plastic coated components in the slurry mixer 120 also reduces rotational friction and lowers power consumption associated with operating the slurry mixer 120. Plastic coated components in the slurry mixer 120 also enhance the ability to accurately transfer slurry from the slurry mixer 120. Additionally, using plastic coated components in the slurry mixer 120 enhances the ability to clean the slurry mixer 120 at the end of the day.

The upper mixing members 146 are offset from the lower mixing members 140, as most clearly illustrated in FIGS. 7 and 8, such that as the lower rotating member 134 is rotated, the lower mixing members 140 pass between the upper mixing members 146. The upper mixing members 146 and the lower mixing members 140 may be configured such that the upper mixing members 146 and the lower mixing members 140 scrape against each other to thereby reduce the accumulation of slurry on the upper mixing members 146 and the lower mixing members 140.

The outer most lower mixing member 140 preferably has a side wiper 147 that slides along the side wall 122 as the lower rotating member 134 is rotated to thereby reduce accumulation of slurry on the side wall 122. A bottom wiper 151 is preferably attached to the lower member 134 so that the bottom wiper 151 slides along the bottom surface 124 of the slurry mixer to reduce accumulation of unmixed cement on the bottom surface 124.

The portable concrete plant 10 has the ability to use admixtures that control and/or enhance characteristics of the ready mix concrete prepared by the portable concrete plant 10. Examples of suitable admixtures are air entrainment materials, conventional and non-corrosive accelerators, and plasticizers. Certain of these admixtures may be added to the slurry mixer 120 while others may be used at other locations such as on the dry material conveyor 190 or at the discharge boot 150, as illustrated in FIG. 3.

The operation of the components of the portable concrete plant 10 is preferably controlled with a hydraulic system. Using the hydraulic system is preferable because hydraulic systems have the ability to produce high levels of forces in a relatively safe and reliable manner. The hydraulic system also permits infinitely variable control of the speed at which components such as the conveyor belt are operated. A person of ordinary skill in the art will appreciate that it is possible to use alternative mechanisms to control the operation of the components of the portable concrete plant 10 using the concepts of the present invention.

The hydraulic system is preferably operated at a pressure of about 2,000 pounds per square inch. Using this moderate pressure level enhances the safety of the components when compared with high-pressure systems that operate at pressures of 5,000 pounds per square inch or more. This moderate pressure level also reduces wear on the pumping head used to generate the pressure used in the hydraulic system. Pumping heads used in conjunction with the hydraulic system preferably have a variable flow configuration that permits the pumping heads to slow down when oil is not needed. This feature also reduces wear on the components of the hydraulic system.

Each of the components that is operated by the hydraulic system preferably has a partial by-pass configuration that permits the component to operate at a very slow rate of rotation even when the component is not activated. By using the by-pass circuit the large initial forces that are imparted when rotation is initially begun are substantially reduced.

The hydraulic system is preferably powered by an internal combustion engine 162 that is mounted to the frame 20. Incorporating the internal combustion engine 162 into the portable concrete plant 10 allows the portable concrete plant 10 to be operated without regard to the proximity of utility service to the location where the portable concrete plant 10 is to be used. A preferred internal combustion engine 162 for use with the portable concrete plant 10 is a diesel engine having a horsepower in that range of 150 to 300 and preferably about 220. A particularly suited internal combustion engine 162 for use with the portable concrete plant 10 is manufactured by Caterpillar Co. A person of ordinary skill in the art will appreciate that it is possible to power the operation of the portable concrete plant 10 with a variety of other techniques such as through electricity.

The internal combustion engine 162 may be removably mounted to the frame 10 on a skid (not shown) that permits the unit to be readily detached from the portable concrete plant 10 for performing maintenance or repair of the internal combustion engine 162.

To power the operation of the internal combustion engine 162, the portable concrete plant 10 preferably includes an on-board fuel storage tank 164. The on-board fuel storage tank 164 has a capacity of between about 50 gallons and 200 gallons and preferably about 100 gallons.

Also operably attached to the internal combustion engine 162 is an air compressor (not shown) to provide compressed air as needed for the operation of certain components on the portable concrete plant 10. For example, the compressed air may be used to convey the cement from the auxiliary bulk cement storage tanker to the cement hopper 40.

The internal combustion engine 162 further preferably includes a high output AC alternator (not shown) operably connected thereto to power the operations of electrically powered components on the portable concrete plant 10. The high output AC alternator facilitates the operation of the portable concrete plant 10 without regard to the availability of electrical power where it is desired to use the portable concrete plant 10. For example, the alternator may be used to provide power for a computer in the control room 170.

The portable concrete plant 10 preferably includes a heat exchanger 168 mounted thereto. The heat exchanger 168 cools hydraulic oil used in the hydraulic system 160 while heating water that is used in preparing the slurry. Heating the water is particularly useful when the portable concrete plant 10 is used in cold climates because the heated water reduces the need to add acceleration or retardation admixtures during the concrete preparation process. Cooling the hydraulic oil in the hydraulic system also increases the efficiency of the hydraulic system.

The portable concrete plant 10 preferably includes a control room 170. The control room 170 provides continuous oversight of the conditions in each of the components of the portable concrete plant 10. The control room 170 permits an operator to adjust nearly all parameters relating to the operation of the portable concrete plant 10. The control room 170 is preferably substantially enclosed to protect the controls from damage by environmental factors such as rain or corrosion by materials being processed in the portable concrete plant 10.

The operation of the portable concrete plant 10 is preferably controlled by at least one computer (not shown) located in the control room 170. The computer preferably permits the individual components of the portable concrete plant 10 to be simultaneously controlled. A person of ordinary skill in the art will also appreciate that alternate methods are possible to control the operation of the portable concrete plant 10.

The portable concrete plant 10 preferably includes levelers 180 that permit the portable concrete plant 10 to be maintained in a level orientation regardless of the conditions at the location where the portable concrete plant 10 is to be used. The levelers 180 thereby obviate or substantially reduce the need to excavate at the intended use site. Preferably there are a series of six levelers 180 with the levelers being spaced around the frame 10. The levelers 180 are extendable varying degrees from the frame 20 using an operable attachment to the hydraulic system. The levelers 180 preferably have a range of motion of up to 24 inches. To further stabilize the portable concrete plant 10, a plate (not shown) may be placed beneath one or more of the levelers 180.

Because of the height of the portable concrete plant 10 when the slurry mixer 24 is in the extended position, a levelers 180 proximate the back end of the portable concrete plant 10 are preferably mounted on outriggers 181. The outriggers 181 are pivotable between a retracted or transport position (as illustrated in FIG. 2) and an extended position (as illustrated in FIG. 9). Pivoting of the outriggers 181 between the extended and retracted positions is preferably controlled by a hydraulic system.

The portable concrete plant 10 has a first conveyor 190 for transferring the ready mix concrete components to the concrete mixing truck. The first conveyor 190 passes beneath the sand flow control mechanism 66 and the rock flow control mechanism 86 to thereby receive sand and rocks from the sand hopper 60 and the rock hopper 80, respectively. The first conveyor 190 conveys the sand and rock to a second conveyor 192. The speed rate at which the first conveyor 190 operates is adjustable to permit precise control of the rate at which sand and rock are delivered to the discharge boot 150.

The second conveyor 192 is preferably operably attached to the pivoting section 216 so that as the pivoting section 216 is moved from the storage position to the extended position, the second conveyor 192 is also moved from a storage position to an extended position.

Proximate the intersection of the first conveyor 190 and the second conveyor 192 is a protective cover (not shown) that extends over the first conveyor 190 and the second conveyor 192 to prevent sand and stones from falling off the first and second conveyors 190, 192. The protective cover may also include a door (not shown) pivotally mounted proximate to an exit thereof to further reduce the potential for sand and rock falling off the first and second conveyors 190, 192. Additionally, the conveyor may include side shields (not shown) that are positioned partially over the conveyors proximate the intersection of the conveyor 190 and the second conveyors 192 to prevent sand and rock from falling off the conveyors.

The discharge boot 150 preferably extends from the back end of the portable concrete plant 10, as most clearly illustrated in FIGS. 1 and 2. However, a person of ordinary skill in the art will appreciate that the discharge boot 150 may also extend from the front end or sides of the portable concrete plant 10 using the concepts of the present invention.

The discharge boot 150 permits adjustment to compensate for different concrete mixers so that charge height can be varied. Because of the position of the concrete discharge boot 150, it is not necessary to excavate a loading pit. It is also possible to pivotally attach an end of the second conveyor 192 that is attached to the discharge boot 150 so that a height of the second conveyor 192 may be adjusted depending on the height of the concrete mixing trucks.

Figure 10:
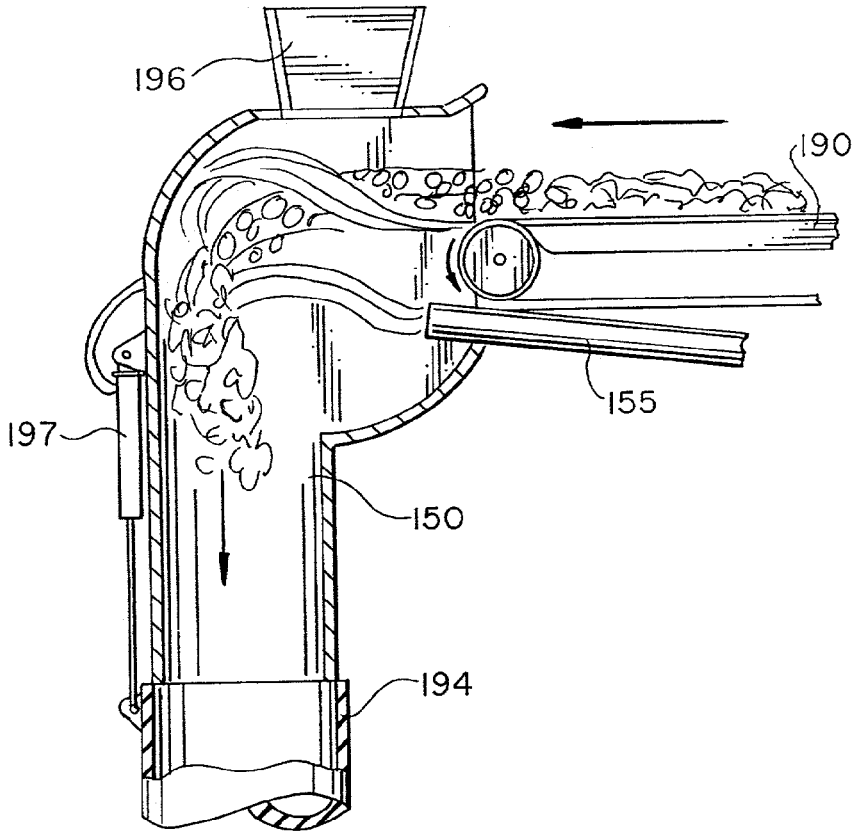
FIG. 10 is a sectional view of a concrete discharge device for the portable concrete plant.

The discharge boot 150 receives rock and sand from the second conveyor 192 and slurry from the slurry mixer 24. The discharge boot 150 imparts a spiral motion to the slurry, rock and sand as these components are fed into the drum of the concrete mixer truck, as most clearly illustrated in FIG. 10. In this technique the slurry is jacketed by the rock and sand to promote uniform mixture of the slurry with the rock and sand. The spiral motion accelerates loading of the sand, rock and slurry while preventing clogging of the discharge boot 150. Using the spiral loading motion also improves the mix quality by blending the rock and sand to prevent material segmentation. The spiral motion imparted by the discharge boot 150 is preferably in the same direction as the spiral motion of the drum on the concrete mixer truck.

The discharge boot 150 preferably has a sleeve 194 extending therefrom. The position of the sleeve 194 with respect to the discharge boot 150 is adjustable such that the sleeve 194 can extend to proximate the concrete mixer truck to minimize spills. Movement of the sleeve 194 with respect to the discharge boot 150 is preferably controlled by a hydraulic cylinder 197.

To further reduce the amount of dust and other materials emitted from the portable concrete plant 10, a drum sealing ring 193 extends from the sleeve 194. When the sleeve 194 is lowered into a feed funnel (not shown) on the concrete mixer truck, the drum sealing ring 193 seats substantially against an upper surface of the feed funnel.

Proximate the discharge boot 150, the portable concrete plant 10 may also include an admix feed chute (not shown). The admix feed chute enables admix, such as an accelerator or reinforcing fibers to be added to the ready mix concrete to thereby strengthen the concrete and obviate or reduce the need to use reinforcing bars or steel mesh in the concrete. The location at which the reinforcing fibers are added to the other components of the ready mix concrete is important because adding these fibers too early in the process presents issues with respect to conveying the reinforcing fibers along with the rest of the components while adding the reinforcing fibers too late precludes evenly dispersing the reinforcing fibers into the ready mix concrete.

Alternatively, the admix or reinforcing fibers may be fed onto the dry material conveyor 190 through the protective cover, as most clearly illustrated in FIG. 3. Feeding the reinforcing fibers in this manner is preferably accomplished through a conveyor 199.

The portable concrete plant 10 of the present invention minimizes the environmental impact on the area surrounding the portable concrete plant 10 because the discharge boot 150 and the sleeve 194 enables the concrete truck to be cleanly loaded. In particular, the concrete loading system of the present invention eliminates or at the very least substantially reduces dry packing on the mixer fins in the drum of the concrete mixer truck. Additionally, the concrete loading system of the present invention eliminates or at the very least substantially reduces dust generated during the process of loading the drum of the concrete mixer truck.

When the portable concrete plant 10 is used in very cold conditions such as at a temperature of less than 20° F., the heat exchanger 168 included in the portable concrete plant 10 is not able to prepare a sufficient amount of heated water that is used in an entire day. For these situations, the portable concrete plant 10 also includes a supplemental hot water system 200.

The supplemental hot water system 200 has a hot water generation component 202 and a hot water storage component 204. The hot water generation component 202 is preferably powered by natural gas, propane and electricity. To enhance the efficiency of the hot water generation component 202, this element is preferably placed in an insulated storage trailer 206 that permits the hot water generation component 202 to be transported to a location where the portable concrete plant 10 is to be used. The hot water generation component 202 is capable of heating the water to a temperature of between 100° F. and 200° F. and preferably about 160° F.

The hot water storage component 204 has sufficient capacity to store substantially all of the heated water that is used during an entire day of preparing ready mix concrete. The storage capacity of the hot water storage component 204 is preferably about 15,000 gallons. To facilitate transporting the hot water storage component 204 along with the other elements of the portable concrete plant 10, the hot water storage component 204 preferably includes three separate tankers that each have a capacity of about 5,000 gallons. The hot water storage component 204 is preferably insulated to reduce the loss of temperature caused by ambient factors. Using the hot water storage component 204 thereby permits water to be heated a day before the heated water is used in the portable concrete plant 10. This system thereby ensures that sufficient heated water is available.

The components flow rate controls of the present invention permit the flow rates of the individual components to be controlled at an accuracy of more than 90 percent, preferably more than 99 percent and most preferably greater than 99.95 percent.

Sand and gravel is preferably provided to the sand storage region 32 and the rock storage region 34 by a feed material conveyor system 182. The feed material conveyor system 182 preferably has a variable speed control to deliver the components accurately.

The feed material conveyor system 182 preferably has two conveyor modules 184 that are operably attached to a base 186 that permits the conveyor modules 184 to be moved between a retracted position and an extended position, as most clearly illustrated in FIG. 3.

When in the extended position, the conveyor modules 184 are moved apart from each other so that the conveyor modules 184 remain in a substantially parallel relationship but so that the conveyor modules 184 are aligned with the hopper into which the material is to be fed.

The feed material conveyor system 182 preferably has a telescoping configuration that permits the individual conveyor belts to be moved apart from each other. Moving the conveyors modules 184 in this manner allows the overall width of the feed material conveyor system 182 to reduced so that the feed material conveyor system 182 can be transported over conventional roads.

The hydraulic system also preferably controls moving the individual conveyor modules 184 apart from each other. Moving the conveyors modules 184 from a retracted position to the extended position preferably takes less than 1 minute. When in the retracted configuration, the conveyor system 182 has a width of less than 100 inches.

The method of preparing and loading the ready mix concrete into the drum of the concrete mixer truck maximizes the rate at which the components are mixed together while preventing dry pack in the drum of the concrete mixer truck. This procedure preferably entails starting the flow of sand a few seconds before the flow of rock is initiated. This technique produces a bed of sand in the mixer into which the rock is wrapped. Additionally, the flow of the lighter and liquefied materials is initiated before the heavier rock. Using the technique of the present invention permits the drum of the concrete truck to be filled with sufficient slurry, rock and sand to produce a batch of approximately 10 cubic yards of ready mix concrete in about 60 to 90 seconds.

The method of the present invention includes the ability to automatically compensate for the moisture level in the rock and sand. The basic mix designs in the control system are selected based upon dry rock and sand. Automatically sampling the moisture level of the aggregates with a moisture level probe as the materials are loaded into the storage hopper enables the control system to automatically compensate for variations in moisture level to thereby enhance the quality of ready mix concrete prepared by the portable concrete plant 10.

In operation, the internal combustion engine 162 is started to create pressure in the hydraulic system. The conveyor modules 184 are activated to fill the sand hopper 60 and the rock hopper 80 with sand and rock, respectively. As the rock and sand are being filled into the sand hopper 60 and the rock hopper 80, respectively, the moisture content of these materials is preferably measured so that water added during the process may be adjusted to compensate for variations in the moisture in these materials. Next, the cement hopper 40 is filled from the auxiliary bulk cement tanker and the water storage vessel 110 is filled from the water supply.

The motor 131 is activated to cause the paddle system 130 to rotate in the slurry mixer 120. Water and cement are fed into the slurry mixer 120 from the water storage vessel 110 and the cement hopper 40 at a ratio of water to cement of between 0.3 and 0.6, preferably between about 0.45 and 0.50, and most preferably about 0.48. Mixing in the slurry mixer 120 is continued until a substantially homogeneous slurry mixture is produced. The mixing is preferably continued for up to 60 seconds, preferably between about 10 seconds and 30 seconds, and most preferably about 15 seconds.

The dispensing auger 128 is then activated to convey the slurry out of the slurry mixer 120 to the discharge boot 150. After each batch of slurry is emptied from the slurry mixer 120, the slurry mixer 120 is refilled with water and cement. Once the level of the rock, sand, cement, and water is depleted to a specified level in their respective storage regions, the appropriate restocking mechanism is activated to replenish the storage regions.

The sand flow control mechanism 66 and the rock flow control mechanism 86 are activated to permit sand and rock to flow from the sand hopper 60 and the rock hopper 80, respectively, onto the dry material conveyor 190. The dry material conveyor 190 is activated to convey the sand and rock towards the discharge boot 150.

The height of the discharge boot 150 and/or the sleeve 194/drum sealing ring 193 are adjusted so that the sleeve 194 is positioned proximate the fill port on the drum of the concrete mixer truck (not shown). When the slurry mixer 120 is in the extended position, the discharge boot 150 is located at least 10 feet above the ground surface. When the slurry mixer 120 is in the transport position, a total height of the portable concrete plant 10 preferably is less than 14 feet so that the portable concrete plant may be transported over conventional roads.

The discharge boot 150 imparts a swirling motion to the sand, rock and slurry as these components pass through the discharge boot 150 and into the drum of the concrete mixer truck. This process is continued until a desired amount of the components are fed into the concrete mixer truck. Rotational motion of the drum causes the sand, rock and slurry to be mixed together in the concrete mixer truck.

Throughout the process, the weight cells on each of the storage regions are monitored by the computer control system in the control room 170 to ensure that the materials are being accurately delivered. When necessary adjustments are made to the settings to reduce the deviation from the desired mixing protocol.

The flow rates of the sand, rock and water are preferably controlled by a fuzzy logic system that adjusts the rates on subsequent batches based upon the results of earlier runs to minimize overshoot and undershoot of target weights. The fuzzy logic system thereby allows the accuracy of the portable concrete plant 10 to increase over time.

When the desired amount of ready mix concrete has been prepared or the end of the day has been reached, the portable concrete plant 10 is cleaned. Water is fed into the slurry mixer 120 to wash any remaining slurry from the slurry mixer 120. The wiping action provided by the side wiper 147 and the lower wiping members 151 remove any remaining slurry from the side wall 122 and from the bottom wall 124. Once all of the components in the portable concrete plant 10 are cleaned to a desired level, the internal combustion engine 162 is shut off.

When the entire project is completed and the portable concrete plant 10 must be moved to another location, the components are cleaned as described above. Any rock, sand, cement and water that remains in their respective storage regions is emptied to minimize the weight of the portable concrete plant 10. Next, the discharge boot 150 is lowered from an operational position to a storage position and the goose neck 18 is attached to the frame 20. The levelers 180 are raised to a storage position so that the wheels 21 are on the ground surface. The portable concrete plant 10 is connected to a tractor for transport to another location.

The following examples are provided to illustrate the use of the portable concrete plant 10 of the present invention and are not intended to limit the scope of the present invention.

EXAMPLE 1

The accuracy of the method of preparing ready mix concrete according to the present invention was evaluated using the portable concrete plant of the present invention. Admix used in this example was a super plasticizer sold under the designation REOBUILD.

The motor 131 was activated to cause the paddle system 130 to rotate in the slurry mixer 120. Water and cement were fed into the slurry mixer 120 from the water storage vessel 110 and the cement hopper 40 at a ratio of water to cement of about 0.48 in the quantities set forth below in Table 1. Mixing in the slurry mixer 120 was continued for approximately 15 seconds until a substantially homogeneous slurry mixture was produced.

The dispensing auger 128 was activated to convey the slurry out of the slurry mixer 120 and to the discharge boot 150. Once the level of the rock, sand, cement, and water in their respective storage regions was depleted to a specified level, the appropriate restocking mechanism was activated to replenish the storage regions.

The sand flow control mechanism 66 and the rock flow control mechanism 86 were activated to permit sand and rock to flow from the sand hopper 60 and the rock hopper 80, respectively, onto the dry material conveyor 190. The dry material conveyor 190 was activated to convey the sand and rock towards the discharge boot 150. The rock, sand and slurry were fed through the discharge boot 150 and into the drum of the concrete mixer truck.

After the batch was completed, the desired and actual amounts of each component were compared. The results of this example are reported in Table 1.

TABLE 1

| Material | Target (pounds) | Actual (pounds) | Error | Moisture Concentration | Water (pounds) |
|---|---|---|---|---|---|
| Sand | 15340.8 | 15,339.9 | 0% | 2.0% | 306.8 |
| Rock | 17786.1 | 17,879.9 | +0.5% | 1.0% | 178.8 |
| Cement | 5,170.0 | 5,200.0 | +0.6% | | |
| Admix | 40.0 | 40.0 | 0% | | |
| Water | 2,273.1 | 2,282.0 | +0.4% | | |

The total weight of aggregates used in this example was 33,219.8 pounds. The total weight of water used in this example was 2,767.6.4 pounds. The total weight of cement used in this example was 5,200.0 pounds. The ratio of water to cement in this example was 0.532. The percent error for each of the components used in this example was less than 0.6 percent by weight.

The ready mix concrete was found to exhibit a 6 inch slump. The air concentration was measured to be approximately 1.9 percent. The ready mix concrete prepare in this example was allowed to cure to evaluate the strength of the concrete. After allowing the sample to cure for seven days, the compressive strength of the concrete was found to be approximately 3,630 pounds per square inch. After allowing the sample to cure for 28 days, the compressive strength was measured for two samples and found to be approximately 5,840 and 6,010 pounds per square inch.

EXAMPLE 2

The method set forth in Example 1 was repeated using different materials. Admix used in this example was a super plasticizer. Steel fibers were also added at a rate of approximately 35 pounds per cubic yard of ready mix concrete. The results of this example are reported in Table 2.

TABLE 2

| Material | Target (pounds) | Actual (pounds) | Error | Moisture Concentration | Water (pounds) |
|---|---|---|---|---|---|
| Sand | 15,503.5 | 15,540.0 | +0.2% | 1.0% | 155.4 |
| Rock | 17,574.0 | 17,599.9 | +0.1% | 1.0% | 176.0 |
| Cement | 5,640.0 | 5,619.9 | −0.4% | | |
| Admix | 450.0 | 450.0 | 0% | | |
| Water | 2,372.5 | 2,384.0 | 0% | | |

The total weight of aggregates used in this example was 33,139.9 pounds. The total weight of water used in this example was 2,715.4 pounds. The total weight of cement used in this example was 5,620.0 pounds. The ratio of water to cement in this example was 0.483. The percent error for each of the components used in this example was less than 0.5 percent by weight.

The ready mix concrete was found to exhibit a 7.25 inch slump. The air concentration was measured to be approximately 1.8 percent. The ready mix concrete prepared in this example was allowed to cure to evaluate the strength of the concrete. After allowing the sample to cure for seven days, the compressive strength of the concrete was found to be approximately 5,370 pounds per square inch. After allowing the sample to cure for 28 days, the compressive strength was measured for two samples and found to be approximately 7,480 and 7,480 pounds per square inch.

It is contemplated that features disclosed in this application, as well as those described in the above applications incorporated by reference, can be mixed and matched to suit particular circumstances. Various other modifications and changes will be apparent to those of ordinary skill.

What claimed is:

1. A portable concrete plant for preparing ready mix concrete, the portable concrete plant comprising:

a frame having at least one set of wheels attached thereto for supporting the frame above a ground surface and permitting the frame to be moved along the ground surface;

a cement storage region attached to the frame, wherein the cement storage region stores cement, and wherein the cement storage region has a cement entry port and a cement exit port;

a sand storage region attached to the frame, wherein the sand storage region stores sand, and wherein the sand storage region has a sand entry port and a sand exit port;

a rock storage region attached to the frame, wherein the rock storage region stores rock, and wherein the rock storage region has a rock entry port and a rock exit port;

a water storage region attached to the frame, wherein the water storage region stores water, and wherein the water storage region has a water entry port and a water exit port;

a slurry mixer attached to the frame, wherein slurry mixer has a slurry mixer entry port and a slurry mixer exit port, wherein the cement exit port and the water exit port are operably connected to the slurry mixer entry port, wherein the slurry mixer prepares a slurry from cement and water; and wherein the slurry mixer exit port is proximate a system exit port;

a conveyor system attached to the frame, wherein the conveyor system receives rock from rock exit port and sand from the sand exit port and transports the rock and sand to the system exit port; and further comprising a mixing apparatus mounted on the frame proximate the system exit port for mixing the rock, sand and slurry wherein the mixing apparatus imparts a swirling motion to the rock, sand and slurry as the rock, sand and slurry pass through the mixing apparatus.

2. The portable concrete plant of claim 1, wherein the slurry mixer is attached to the frame with a slurry mixer support frame, wherein the slurry mixer support frame has a stationary portion and a pivoting portion, wherein the stationary portion is attached to the frame, wherein the slurry mixer is attached to the pivoting portion, and wherein the pivoting portion is pivotally attached to the stationary portion so as to enable the slurry mixer to pivot between a transport position and an extended position.

3. The portable concrete plant of claim 2, wherein the portable concrete plant has a height of less than about 14 feet, when the slurry mixer is in the transport configuration, and wherein the system exit port is positioned at a height of at least 10 feet when the slurry mixer is in the extended position.

4. The portable concrete plant of claim 2, wherein the conveyor system pivots between the extended position and the transport position as the slurry mixer is pivoted between the extended position and the transport position.

5. The portable concrete plant of claim 1, and further comprising:

a cement weight monitoring mechanism operable attaching the cement storage region to the frame; and a sand weight monitoring mechanism operable attaching the sand storage region to the frame;

a rock weight monitoring mechanism operable attaching the rock storage region to the frame;

a water weight monitoring mechanism operable attaching the water storage region to the frame.

6. The portable concrete plant of claim 1, wherein the slurry mixer comprises:

an outer enclosure;

a first stirring apparatus fixedly mounted to the outer enclosure; and a second stirring apparatus rotatably mounted in the outer enclosure.

7. The portable concrete plant of claim 1, wherein the cement storage region, the sand storage region, the rock storage region, and the water storage region each include a load cell for continuously measuring the weight of components therein.

8. The portable concrete plant of claim 1, and further comprising an internal combustion engine attached to the frame for powering the operation of the portable concrete plant.

9. The portable concrete plant of claim 1, and further comprising a heat exchanging apparatus attached to the frame, wherein the heat exchanging apparatus heats water being delivered to the water storage region and cools hydraulic oil used to operate the components in the portable concrete plant.

10. The portable concrete plant of claim 1, and further comprising a control room attached to the frame, wherein the control room includes controls for controlling the operation of the portable concrete plant.

11. A system for preparing ready mix concrete, the system comprising:

a portable concrete plant comprising:

a frame having at least one set of wheels attached thereto for supporting the frame above a ground surface and permitting the frame to be moved along the ground surface;

a cement storage region attached to the frame, wherein the cement storage region has a cement entry port and a cement exit port;

a sand storage region attached to the frame, wherein the sand storage region has a sand entry port and a sand exit port;

a rock storage region attached to the frame, wherein the rock storage region has a rock entry port and a rock exit port;

a water storage region attached to the frame, wherein the water storage region has a water entry port and a water exit port;

a slurry mixer attached to the frame, wherein slurry mixer has a slurry mixer entry port and a slurry mixer exit port, wherein the cement exit port and the water exit port are operably connected to the slurry mixer entry port, wherein the slurry mixer prepares a slurry from cement and water, and wherein the slurry mixer exit port is located proximate a system exit port;

a conveyor system attached to the frame, wherein the conveyor system receives rock from rock exit port and sand from the sand exit port and transports the rock and sand to a the system exit port, and wherein the slurry mixer comprises:

an outer enclosure;

a first stirring apparatus fixedly mounted to the outer enclosure; and a second stirring apparatus rotatably mounted in the outer enclosure.

12. The system of claim 11, wherein the slurry mixer is attached to the frame with a slurry mixer support frame, wherein the slurry mixer support frame has a stationary portion and a pivoting portion, wherein the stationary portion is attached to the frame, wherein the slurry mixer is attached to the pivoting portion, and wherein the pivoting portion is pivotally attached to the stationary portion so as to enable the slurry mixer to pivot between a transport position and an extended position.

13. The system of claim 12, wherein the portable concrete plant has a height of less than about 14 feet, when the slurry mixer is in the transport configuration, and wherein the system exit port is positioned at a height of at least 10 feet when the slurry mixer is in the extended position.

14. The system of claim 12, wherein the conveyor system pivots between the extended position and the transport position as the slurry mixer is pivoted between the extended position and the transport position.

15. The system of claim 11, and further comprising:

a cement weight monitoring mechanism operably attaching the cement storage region to the frame; and a sand weight monitoring mechanism operable attaching the sand storage region to the frame;

a rock weight monitoring mechanism operable attaching the rock storage region to the frame; and a water weight monitoring mechanism operable attaching the water storage region to the frame.

16. The system of claim 11, where in the slurry mixer has a self-cleaning configuration in which the first stirring apparatus and the second stirring apparatus clean each other and the second stirring apparatus cleans an inner surface of the outer enclosure as the second stirring apparatus is rotated in the outer enclosure.

17. The system of claim 11, and further comprising a mixing apparatus mounted on the frame proximate the system exit port for mixing the rock, sand and slurry.

18. They system of claim 17, wherein the mixing apparatus imparts a swirling motion to the rock, sand and slurry as the rock, sand and slurry pass through the mixing apparatus.

* * * * *